US009133573B2

(12) United States Patent
Vanhazebrouck et al.

(10) Patent No.: US 9,133,573 B2
(45) Date of Patent: Sep. 15, 2015

(54) AGITATOR COMPRISING A FLOATING ELEMENT

(75) Inventors: Vicente Marconcin Vanhazebrouck, Curitiba-PR (BR); Marcelo Piekarski, Curitiba-PR (BR); Álvaro Junior Volpato, Curitiba-PR (BR)

(73) Assignee: ELECTROLUX DO BRASIL S.A., Curitiba (BR)

( * ) Notice: Subject to any disclaimer, the term of this patent is extended or adjusted under 35 U.S.C. 154(b) by 458 days.

(21) Appl. No.: 13/701,975

(22) PCT Filed: Jun. 3, 2011

(86) PCT No.: PCT/BR2011/000171

§ 371 (c)(1),
(2), (4) Date: Feb. 13, 2013

(87) PCT Pub. No.: WO2011/150483

PCT Pub. Date: Dec. 8, 2011

(65) Prior Publication Data

US 2013/0199248 A1 Aug. 8, 2013

(30) Foreign Application Priority Data

Jun. 4, 2010 (BR) ..... PI1001845-0

(51) Int. Cl.

| | |
|---|---|
| ***D06F 13/00*** | (2006.01) |
| ***D06F 13/02*** | (2006.01) |
| ***D06F 17/06*** | (2006.01) |
| ***D06F 17/10*** | (2006.01) |
| *D06F 23/04* | (2006.01) |

(52) U.S. Cl.

CPC ..... *D06F 13/00* (2013.01); *D06F 13/02* (2013.01); *D06F 17/06* (2013.01); *D06F 17/10* (2013.01); *D06F 23/04* (2013.01)

(58) Field of Classification Search

CPC ..... D06F 17/06; D06F 17/10; D06F 13/00; D06F 13/02

USPC ..... 68/23.6, 134

See application file for complete search history.

(56) References Cited

U.S. PATENT DOCUMENTS 2,763,147 A * 9/1956 Thiele ..... 68/134
3,021,997 A 2/1962 Czech (Continued)

OTHER PUBLICATIONS

International Search Report dated Dec. 1, 2011.

*Primary Examiner* — Joseph L Perrin

(74) *Attorney, Agent, or Firm* — Banner & Witcoff, Ltd.

(57) ABSTRACT

Agitator provided with floating element with blades applied in washing machine, more particularly, it's about an agitator of the type applied in clothes washing machines, preferentially with top load, conventionally provided with a water reservoir or tank, a perforated basket with pulsing/alternated spin movement, configuring the place where the clothes are accommodated; the agitator element is from type installed at the bottom of the basket and in the center of the same, and it can be followed by an accessory, provided with vertical blades, integrated to the pulsing rotating system of the basket, the agitator includes a base sector with skirt shape configuration which surface is multi-perforated and provided with radial threads, equidistantly distributed; from the interior face of the plan is developed the tubular body that, along with the lateral wall of the skirt configures space for the assembly of a floating element with radial vertical blades dimensioned for acting at the respective radial threads; referred floating element has a vertical displacement course foreseen between the internal face of the surface and the bumper ring appropriately fixed at the base of the tubular body for allowing the blades to adopt a projecting position in projection or a collected position with regards to the surface based on the existence or not of water inside the reservoir/basket of the clothing washing machine.

15 Claims, 5 Drawing Sheets

(56) References Cited

U.S. PATENT DOCUMENTS

| | | | | |
|---|---|---|---|---|
| 3,388,570 | A * | 6/1968 | Cobb et al. | 68/134 |
| 3,399,552 | A * | 9/1968 | Salisbury et al. | 68/134 |
| 3,401,540 | A * | 9/1968 | Platt et al. | 68/134 |
| 4,813,248 | A | 3/1989 | Smith et al. | |
| 5,927,105 | A * | 7/1999 | Cho | 68/23.6 |
| 2006/0162094 | A1 * | 7/2006 | La Belle et al. | 8/159 |
| 2006/0162395 | A1 | 7/2006 | La Belle et al. | |

* cited by examiner

CORTE A.A

CORTE B.B

AGITATOR COMPRISING A FLOATING ELEMENT

CROSS REFERENCE TO RELATED APPLICATIONS

The present application is a U.S. National Phase Application under 35 USC §371 of co-pending PCT Application No. PCT/BR11/00171, filed Jun. 3, 2011, which claims priority to BR Application No. P11001845-0, filed Jun. 4, 2010. Applicant hereby claims the benefit of priority of each application and the disclosure of each application is hereby incorporated by reference in its entirety.

TECHNICAL FIELD

The present disclosure refers to an agitator provided with a floating element with blades applied to washing machines, where the floating of the referred element at the washing tub is naturally performed and associated to the tank's water inflow and outflow. The agitator optimizes the level of cleanliness of the clothes, without, however, aggressing or damaging the referred clothes during a pre-drying or centrifugation step.

BACKGROUND

It's general acknowledgment that the contemporary machines are manufactured in two basic models: front load or top load. The top load machines receive the clothes in a cylinder vertically assembled, with a central agitator and having an articulated lid at the superior base. The front load machines, in turn, have an horizontally assembled cylinder, without central agitator, but with a rotating basket which washes the clothes by tipping; it has a front airtight door provided with glass viewer.

The object of the present description is applied to top load type machines that, in general, are supplied with a water reservoir which is fixedly assembled, provided with a perforated basked with alternated/pulsing movement where the clothes are accommodated. At the bottom of the basket and at the center of the same the agitator element is assembled, integrated to the pulsing rotation system of the machine which also includes a washing system comprising power feeding mechanism assembled below and outside the reservoir which transfers the power necessary to the washing, as well as the duct for water inflow and outflow.

The agitating elements, in turn, present different configurations and they are very important for these types of washing machines, because, along with the pulsing movement of the basket, they promote a water eddy able to move the clothes in different directions, making possible to the detergent and water perform the washing along with the friction between the clothes. A preferential standard for washing a load of clothes, produced by the pulsing movement of the basket and agitator, specially by the fins practiced on the agitator and, in some cases, also at the internal surface of the basket, comprises the action of revolving the clothes items initially downward (to the bottom of the basket), then radially outside (against the basket's wall) and finally upward, along the peripheral wall of the basket, completing a cycle which is continued and repeated during a certain time of the washing program.

In a general modality, the agitator comprises a base portion, generally in a cylinder shape, which from the center, a central tower is elevated, so that, both at base surface and peripheral surface of the tower can have multiple fins or external projections, generally distributed in a radial way.

The clothes washing machines market reveals a certain diversity of models of fins applied both at the agitator and basket's wall, because the shape and quantity of them, applied to the system, have big influence on the type of wash that the machine can perform, in other words, which type of clothes that model of machine is able to wash, as well as the effectiveness of that machine's washing.

It's known, among the qualified ones, that the height of the fins is also object of studies, because higher fins, in other words, more elevated with regards to the surface of the base and tower, have a good function during the clothes washing, in other words, they produce bigger agitation of the water and, consequently, bigger movement and friction between the clothes, but they are not a good option during the clothes' centrifugation or pre-drying, because, in this step, the higher fins can damage or even shred some pieces which tissue is fragile or more delicate.

For this reason, is common to find washing machines which fins present dimensioned height between the average and low graduation, up to 8 mm, aiming to produce certain agitation during the washing, at a rate of aggressiveness which objective the cleaning of the clothes, avoiding, however, that when drying, the height of the fins does not damage the tissue during the pre-drying (centrifugation). However, the average height of the fins does not meet a wide range of tissues which need bigger efforts during washing.

Therefore, it's agreed between the manufacturers that the average height, currently employed on clothing washing machines, is not the ideal one, mainly when it's about washing clothes which tissues have bigger resistance to deceleration, such as jeans, wool coats, sneakers and others and then, there is not a constant search for improvements related to this subject.

An example is found on document n. PI 9601531-4, of claimant's own ownership, which is presented one or more mobile devices or accessories to be fit in corresponding inferior fins of the agitator. The referred mobile devices are coupled when it's necessary to wash clothes of more resistant tissue and/or sneakers which can be withdrawal after accomplishment of the service, when the fins come back to their original configuration.

Although the effectiveness on meeting the users' needs, it's noted that the mobile devices depend, necessarily, on the action of the user for their installation and withdrawal, which is not always performed by the same who, when not installing the mobile devices, does not use the ideals proposed by the object.

Another document, n. PI 983785 presents means which aim to obtain the result of a less aggressive wash when on pre-drying or centrifugation, comprising, for such, a perforated basket for clothing containment and inside a tank, being such tank vertically displaceable with regard to the wash liquid level in the tank, between centrifugation and an agitation position, where it remains rotationally stationary. Such characteristics reveal a direction for reducing the efforts over the clothes during pre-drying, but it depends on a complex mechanism for vertically moving the basket, employing gears and other components of addable costs to the final value of the machine.

Verifying the current state of the art, it was certified that some clothes washing machines known by 'wash-dry', in other words, from the type which use devices for drying the clothes with hot air after washing, are equipped with mobile fins internal to the washing basket, and where the said fins or ribs are elevated or collected with regards to the basket's wall, aiming to detach the clothes from the wall soon after the centrifugation, in other words, just before starting the hot air drying, providing a better clothes accommodation.

SUMMARY

Thus, after finalizing the state of the art and aiming to present a device which acts on the clothes washing machine for helping the washing of the same, without, however, being aggressive during pre-drying or centrifugation steps, an agitator provided with a floating element with blades which operation tends to optimize the performance of the washing, once with the water inflow on the reservoir and basket, the floating element and the respective blades are activated in vertical displacement with regards to the fixed base of the agitator, adopting a height such that the blades remain in projection with regards to the surface of the agitator's base, performing the ideal agitation of the water and the necessary aggressiveness for washing the clothes and, at pre-drying step, in other words, with the reservoir's water outflow, the floating element is displaced down, making the blades being retracted regarding the surface of the agitator's base, allowing that the torsion of the clothes occurs during the centrifugation, not being aggressive in this step.

Such effect is obtained by the fact that the floating element with radial and vertical blades comprise a hollow member, such as a buoy, assembled between the bottom face of the water reservoir tank and the inferior face at the base of the agitator, which, in turn, have corresponding radial tears for the vertical movement—ascending or descending—of the radial blades of the floating element. The movement of the floating element is related to the water inflow and outflow inside the machine's tank.

Besides the brief exposition of the innovated object, the primary objective of the present disclosure is providing an automatic washing machine which has a simple technical solution which does not require high technology for manufacturing the involved parts, which generates a very important cost-benefit, because there is the real optimization of the washing without aggressiveness on pre-drying with low cost, which does not interfere on the final price for the consumer.

Another great advantage of this technical solution based on the natural movement of the floating element is on the fact that the same can be applied to conventional washing machines, in other words, not necessarily at 'dry-wash' washing machines, generating big gain for the final consumer.

Alternatively, the floating element can be locked for that it remains on a single position during one or all washing cycles. Such locking can be made by different means, from the manual activation of a lock placed on agitator itself or on the floating element, until electronic activation, performed through control panel, which performs the automatic locking of the system.

BRIEF DESCRIPTION OF THE DRAWINGS

For complementing the present description for obtaining a better comprehension of the characteristics of the present disclosure and according to a preferential practical performance of the same, follows, attached to the description, a set of drawings, where, as the example, although it's not limitating, represents the following.

DETAILED DESCRIPTION

In reference to drawings, the present disclosure refers to an agitator comprising a floating element. Particularly, it's about an agitator (1) of the type applied in clothing washing machines (M), preferentially with top load, conventionally provided with a water tank or reservoir (R), a perforated basket (C), with pulsing/alternated spin, configuring the place where the clothes are accommodated (not shown); the agitator element (1) is the type installed on the bottom of the basket and in the center of the same, and it can be followed by an accessory (AC) provided with vertical blades (AL), integrated to the basket's (C) pulsing rotating system.

Figure 1:
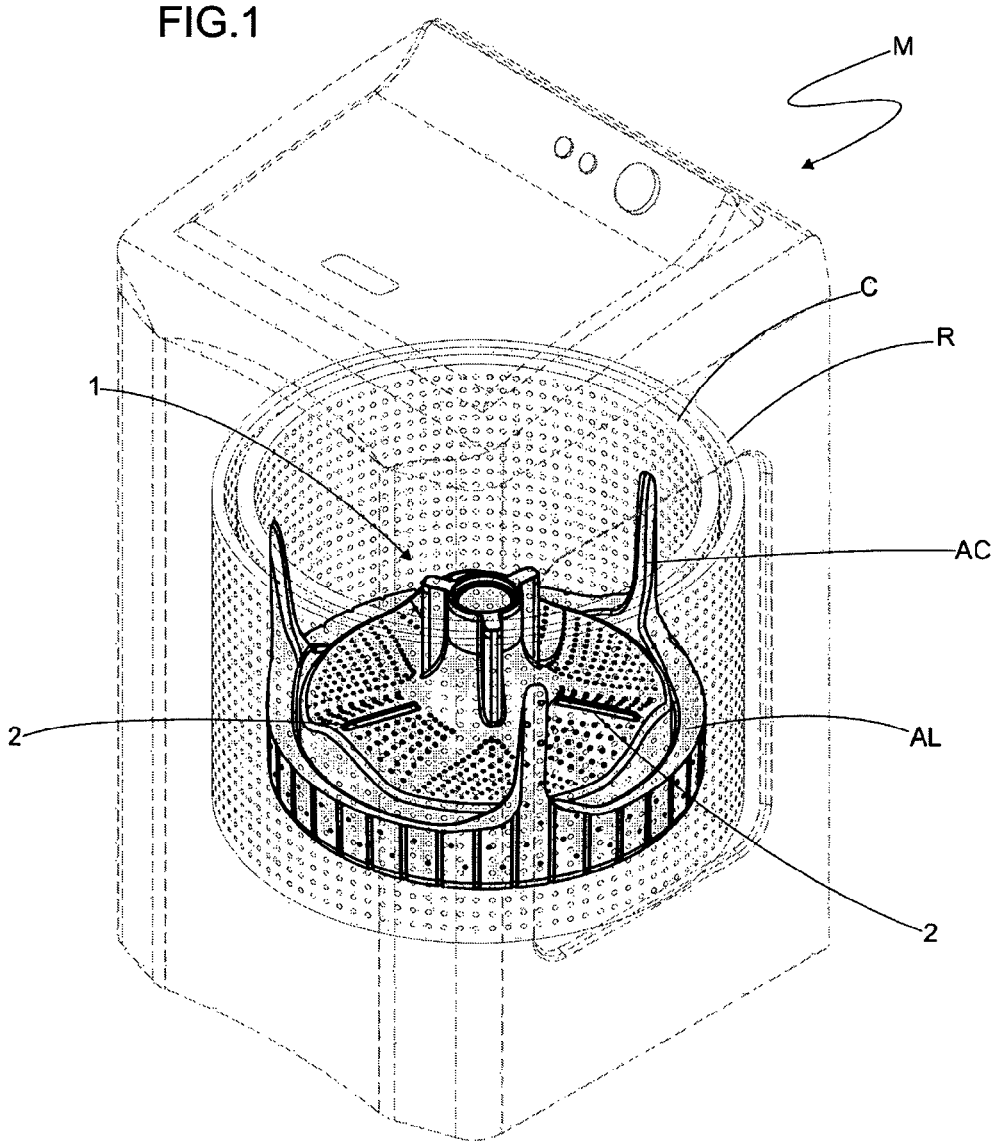
FIG. 1 shows a top load type washing machine, provided with an agitator with the respective floating element with blades.
Figure 2:
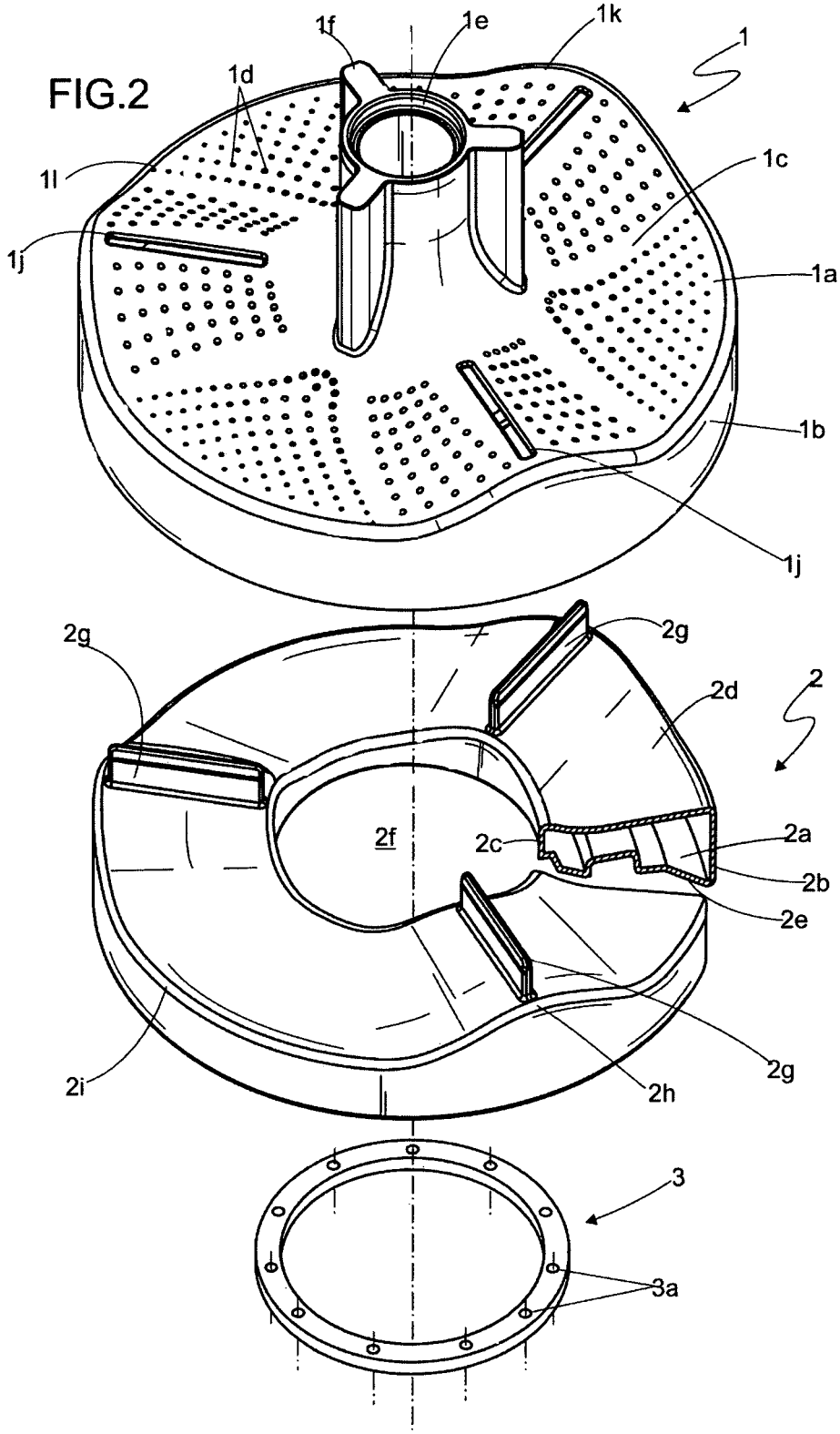
FIG. 2 represents an exploded view of the main innovations, which are the base of the agitator, the floating element with blades and the assemblage ring between the referred parts.
Figure 3:
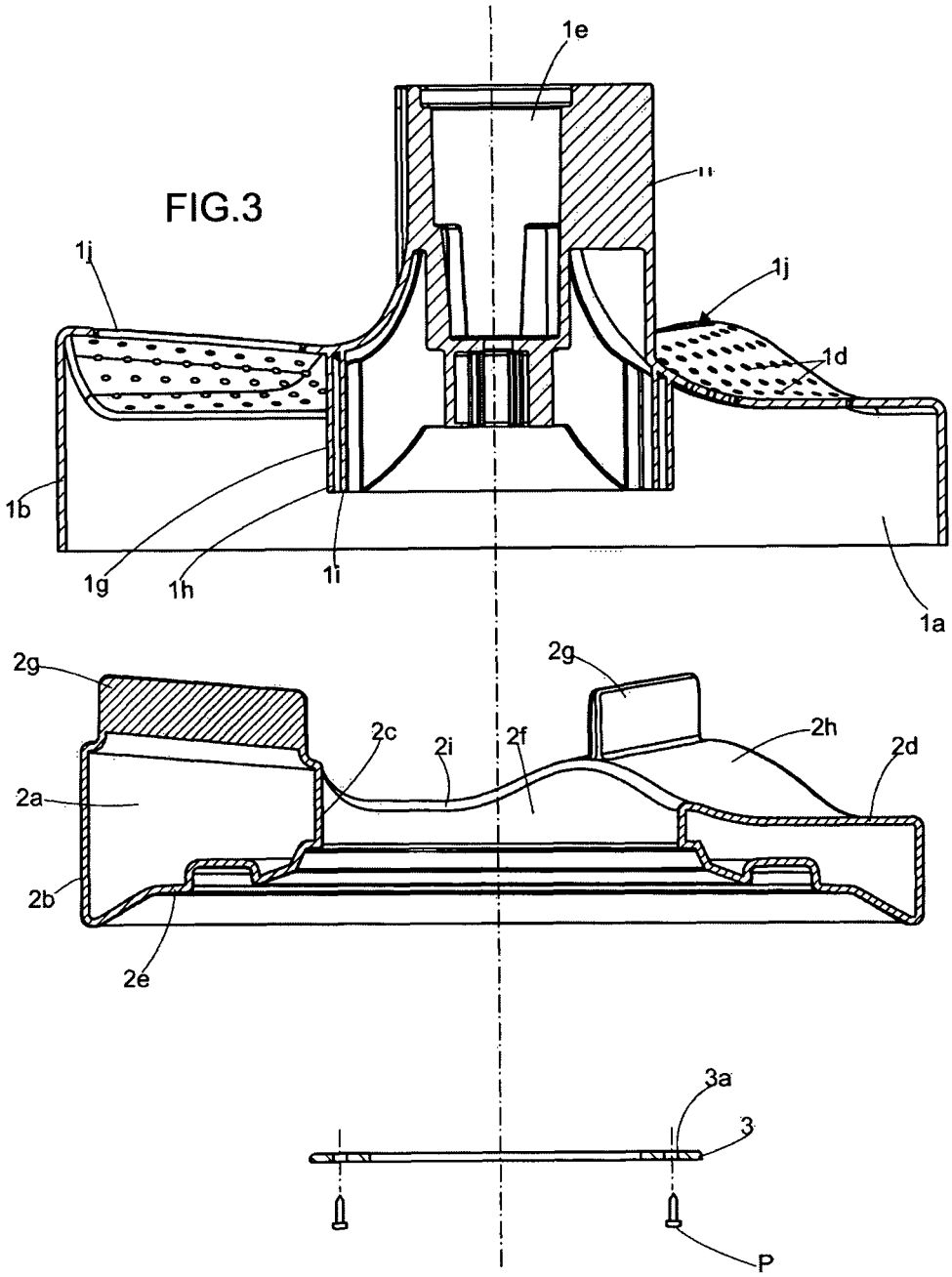
FIG. 3 shows a cross-sectional view of the agitator's base and the floating element with blades and the assembly ring between the referred parts.

According to the present disclosure, the agitator (1) includes a base sector with settings in skirt (1*a*) shape, constituted by vertical lateral wall (1*b*), in agreement with a surface (1*c*), multi-perforated (1*d*); from the central sector of the surface (1*c*) a tubular cone (1*e*) is elevated, provided with fins (1*f*), as long as, axially to this cone, the internal region of the skirt (1*a*) foresees a tubular body (1*g*) (FIG. 3), which free end presents a surrounding flap (1*h*) provided with screw threads perforations (1*i*); the surface (1*c*) is provided with radial threads (1*j*), equidistantly distributed.

On the internal sector of the skirt (1*a*) of the agitator's base (1) a floating element (2) is assembled, constituted by a ordinarily cylindrical and hollow body (2*a*), shaped with external (2*b*) and internal (2*c*) lateral walls, as well as superior face (2*d*) and inferior face (2*e*) for compounding a hollow central span (2*f*), able to accommodate the section of the tubular body (1*g*) of the agitator's base (1), and this one being fixed through fixation ring (3) provided with orifices (3*a*) trespassed by respective fixation means such as screws (P). The surface (2*d*) of the element (2) is equipped with vertical blades (2*g*) dimensioned for being vertically displaced in the interior of the threads (1*j*) foreseen at the base (1*c*) of the agitator (1). The element (2) flows inside the skirt (1*a*) so that the blades (2*g*) adopt a projecting position (F2) or a collected position (F1) with regard to the surface (1*c*) based on the existence or not of water inside the reservoir (R)/basket (C) of the clothing washing machine (M).

In a preferential constructive option, the agitator (1) foresees that on this top base (1*c*) regions in elevation (1*k*) in soft convex radium are presented where radial threads are practiced (1*j*), being that the elevation regions (1*k*) are intermingled by depression regions (1*l*), also manufactured in soft concave arches.

In agreement with the preferential construction aforementioned, the floating element is presented with the surface (2*d*) formed by regions in elevation (2*h*), in soft convex arch, in the top where the respective blades are applied (2*g*); between the regions in elevation (2*h*) depression regions are foreseen (2*i*), manufactured in soft concave arches.

Figure 5:
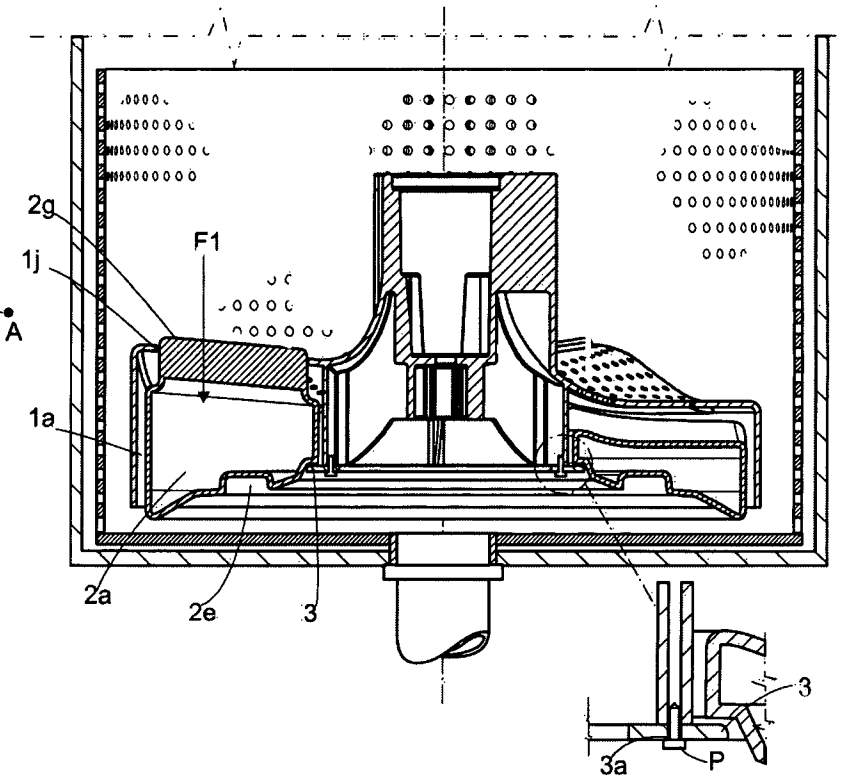
FIG. 5 shows the set of the agitator's base and floating element with collected blades, such as represented on FIG. 4, the said set assembled in the clothes washing machine's basket and reservoir.
Figure 4:
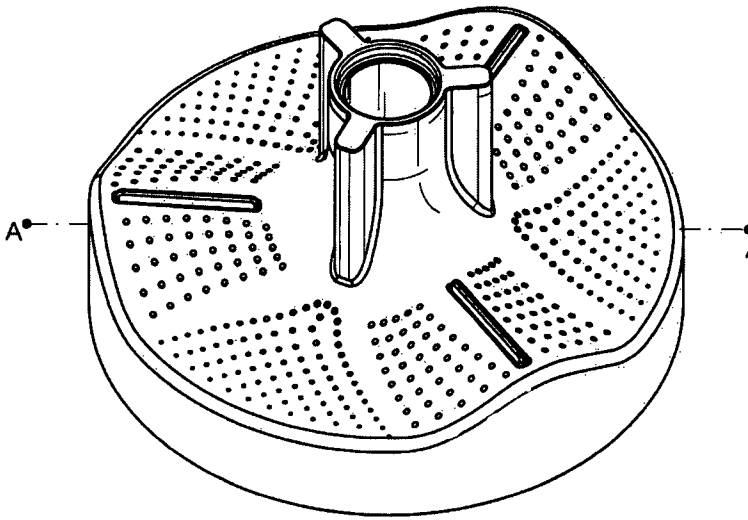
FIG. 4 represents a perspective of the agitator's base and the floating element with collected blades; in other words, lowered with regards to the surface of the agitator's base, position happening when the water from the reservoir and wash basket was drained (pre-drying step)
Figure 7:
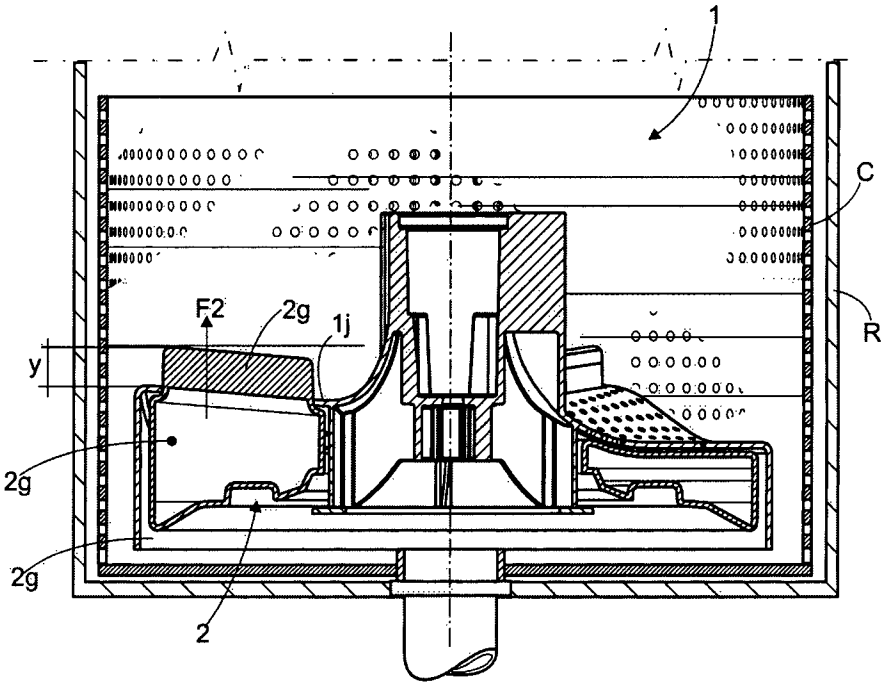
FIG. 7 shows the set of the agitator's base and floating element with activated blades, such as represented on FIG. 6, the said set assembled in the clothing wash machine's basket and reservoir.
Figure 6:
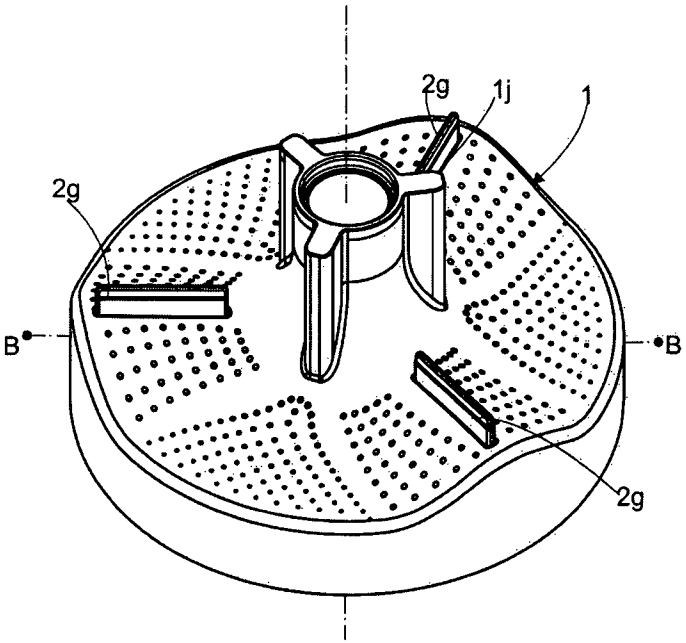
FIG. 6 represents a perspective of the agitator's base and the floating element with activated blades; in other words, elevated with regards to the surface of the agitator's base, position happening when there is water inside the reservoir and wash basket.

The blades (2*g*) activation or collection operation of the floating element (2) with regards to the surface (1*c*) of the agitator (1) consists on the following:

(a) with water inflow on the reservoir (R) and basket (C) (FIG. 6 and FIG. 7), the floating element (2) and respective blades (2*g*) are vertically displaced upwards in position (F2) with regards to the fixed base (1*a*) of the agitator (1), adopting a height limited by the contact of the superior face (2*d*) with the inferior face of the surface (1*c*), allowing that the blades remain in projection (y) with regards to the surface (1*c*) of the agitator's base (1), promoting the ideal agitation of the water and necessary aggressiveness for washing the clothes;

(b) when at pre-drying or centrifugation steps (FIG. 4 and FIG. 5), in other words, with the reservoir's water outflow (R), the floating element (2) is vertically displaced downwards in position (F1) with regards to the fixed base of the agitator (1), making the blades (2*g*) being collected at threads (1*j*) with regards to the surface (1*c*) of the agitator's base (1) and where the inferior base (2*e*) of the floating element is accommodated over the ring (3), allowing that the torsion of the clothes doesn't occur during the centrifugation, without the blades (2*g*) are aggressive to the clothes in this step.

Thus, the floating element (2) performs a vertical displacement course foreseen between the internal face of the surface (1*c*) and the bumper ring (3) fixed at the base of the tubular body (1*g*) for allowing that the blades (2*g*) adopt a projecting position (F2) or a collected position (F1) with regard to the surface (1*c*) based on the existence or not of water inside the reservoir (R)/basket (C) of the clothes washing machine (M).

Alternatively, the floating element (2) can be locked for that it remains on a single position during one or all washing cycles. Such locking can be made by different means, from the manual activation of a lock (not shown) placed on agitator itself (1) or on the floating element (2), until electronic activation, performed through machine's control panel (M), which performs the automatic locking of the system.

When the present disclosure is applied, changes can be made to certain construction and shape details, without departing from the main principles clearly substantiated. It is understood that the employed terminology has a non-limiting purpose.

The invention claimed is:

1. An agitator for use in a washing machine comprising:
- a top surface comprising an external face, an internal face, a plurality of perforations, and a plurality of threads;
- a tubular body projecting downward from the internal face of the top surface;
- a rotation ring fixed to a base of the tubular body; and
- a floating element comprising a superior face, an inferior face, and a plurality of vertical blades, wherein the floating element is configured to move between a collected position and a projecting position, wherein when the floating element is in the collected position at least a portion of the inferior face is in contact with the rotation ring, and wherein when the floating element is in the projecting position at least a portion of the superior face is in contact with the internal face of the top surface such that each of the plurality of vertical blades project through a corresponding thread of the plurality of threads and extend beyond the external face of the top surface.

2. The agitator of claim 1, wherein the floating element further comprises a substantially cylindrical internal lateral wall forming a hollow central span, and wherein the tubular body is located within the hollow central span.

3. The agitator of claim 1, wherein the base of the tubular body comprises a flap, and wherein the rotation ring is fixed to the flap.

4. The agitator of claim 1, wherein the top surface further comprises a plurality of convex top-surface elevated regions and a plurality of concave top-surface depressed regions, wherein each of the plurality of threads is located at a corresponding convex top-surface elevated region.

5. The agitator of claim 4, wherein the superior face of the floating element further comprises a plurality of convex floating-element elevated regions and a plurality of concave floating-element depressed regions, wherein each of the plurality of vertical blades is located at a corresponding convex floating-element elevated region.

6. The agitator of claim 1 further comprising:
- a locking device, wherein the locking device is configured to prevent movement of the floating element between the collected position and the projecting position when the locking device is in a locked state, and wherein the locking device is further configured to permit movement of the floating element between the collected position and the projecting position when the locking device is in an unlocked state.

7. The agitator of claim 1, wherein the floating element is further configured to move to the projecting position during a washing operation of the agitator and move to the collected position during a centrifugation operation of the agitator.

8. A top-load washing machine comprising:
- a substantially cylindrical water reservoir fixed about a substantially vertical axis;
- a substantially cylindrical perforated basket located inside the water reservoir and configured to spin about the substantially vertical axis; and
- an agitator located within the perforated basket and configured to spin with the perforated basket about the substantially vertical axis, wherein the agitator comprises:
  - a top surface comprising an external face, an internal face, a plurality of perforations, and a plurality of threads;
  - a tubular body projecting downward from the internal face of the top surface;
  - a rotation ring fixed to a base of the tubular body; and
  - a floating element comprising a superior face, an inferior face, and a plurality of vertical blades, wherein the floating element is configured to move between a collected position and a projecting position, wherein when the floating element is in the collected position at least a portion of the inferior face is in contact with the rotation ring, and wherein when the floating element is in the projecting position at least a portion of the superior face is in contact with the internal face of the top surface such that each of the plurality of vertical blades project through a corresponding thread of the plurality of threads and extend beyond the external face of the top surface.

9. The top-load washing machine of claim 8, wherein the floating element further comprises a substantially cylindrical internal lateral wall forming a hollow central span, and wherein the tubular body is located within the hollow central span.

10. The top-load washing machine of claim 8, wherein the base of the tubular body comprises a flap, and wherein the rotation ring is fixed to the flap.

11. The top-load washing machine of claim 8, wherein the top surface further comprises a plurality of convex top-surface elevated regions and a plurality of concave top-surface depressed regions, wherein each of the plurality of threads is located at a corresponding convex top-surface elevated region.

12. The top-load washing machine of claim 8, wherein the superior face further comprises a plurality of convex floating-element elevated regions and a plurality of concave floating-element depressed regions, wherein each of the plurality of vertical blades is located at a corresponding convex floating-element elevated region.

13. The top-load washing machine of claim 8 further comprising:

a locking device, wherein the locking device is configured to prevent movement of the floating element between the collected position and the projecting position when the locking device is in a locked state, and wherein the locking device is further configured to allow movement of the floating element between the collected position and the projecting position when the locking device is in an unlocked state.

14. The top-load washing machine of claim 8, wherein the floating element is further configured move to the projecting position when water enters the water reservoir and move to the collected position when water exits the water reservoir.

15. The top-load washing machine of claim 8, wherein the floating element is further configured to move to the projecting position during a washing operation of the top-load washing machine and move to the collected position during a centrifugation operation of the top-load washing machine.

* * * * *